United States Patent [19]

Klein

[11] 4,402,364

[45] Sep. 6, 1983

[54] FIRE EXTINGUISHING METHOD

[76] Inventor: Max Klein, P.O. Box 3, Dalton, Mass. 01226

[21] Appl. No.: 331,531

[22] Filed: Dec. 17, 1981

[51] Int. Cl.[3] ..... A62C 1/00; A62C 3/00

[52] U.S. Cl. ..... 169/47; 252/2; 252/3; 252/8.05

[58] Field of Search ..... 169/46, 47, 66; 252/2, 252/3, 8.05

[56] References Cited

U.S. PATENT DOCUMENTS

| | | | |
|---|---|---|---|
| 3,033,291 | 5/1962 | Wieslander | 169/47 |
| 3,480,546 | 11/1969 | Bashaw et al. | 252/3 X |
| 3,669,191 | 6/1972 | Livingston | 169/45 |
| 3,684,018 | 8/1972 | Rainaldi et al. | 252/3 X |
| 3,912,647 | 10/1975 | Adell | 252/2 X |
| 4,031,961 | 6/1977 | Globus | 169/47 |
| 4,149,599 | 4/1979 | Chiesa, Jr. | 169/47 |
| 4,209,407 | 6/1980 | Schuierer et al. | 252/3 |

*Primary Examiner*—Leland A. Sebastian

*Attorney, Agent, or Firm*—Dann, Dorfman, Herrell and Skillman

[57] ABSTRACT

Class A and Class B fires are extinguished by applying to the burning material a composition consisting essentially of polymer micro-bits and water.

4 Claims, No Drawings

FIRE EXTINGUISHING METHOD

The present invention relates to a fire extinguishing method, and more particularly to a method employing polymer micro-bits and water as the fire extinguishing agent.

Conventional fire fighting techniques generally involve counteracting one or more of the three essential ingredients for igniting and sustaining a fire, namely, fuel, heat and oxygen. Thus, it is well known to apply to a fire substances which cool the burning material below its ignition point, and/or provide a layer or blanket of an inert gas or solid over the burning material, preventing access of oxygen.

The most widely used cooling agent is water, due to its effectiveness, ready availability and low cost. In addition, water is converted to steam when heated sufficiently by a fire, thereby producing an added smothering effect. However, the use of water in fire fighting is not without disadvantages. Because water flows from the point of application, much of its cooling capacity is not utilized in fire fighting. This is true even when wetting and foaming agents are added to the water. Moreover, the resultant run-off may cause serious property damage where fires occur in dwellings or business establishments. In addition, water should only be used in extinguishing wood or paper fires (Class A), and is to be avoided in fighting organic liquid fires (Class B), such as gasoline or fuel oil, since water is likely to spread such fires. Furthermore, the smothering effect of steam is rather limited because steam is rapidly displaced by air.

A number of chemical extinguishing compositions and methods have been developed in order to overcome one or more of the above-noted disadvantages of water. These include the use of carbon dioxide, halogenated hydrocarbons (e.g., Halons), dry chemicals (e.g., sodium bicarbonate or monobasic ammonium phosphate), foams, and "light water", i.e. an aqueous solution of a film-forming fluorocarbon surfactant and a water-soluble thickener, which is used against certain types of chemical fires. Most of these chemical fire fighting agents function by cutting off the oxygen supply, and some, such as sodium bicarbonate, additionally cool the burning material. A number of such products are commercially available and are generally useful in fighting all classes of fires. Although chemical extinguishing agents are satisfactory in many respects, they also have certain shortcomings. In view of their relatively high manufacturing costs, the expense involved in using these products is considerable, particularly for large scale applications, e.g. in fighting brush or forest fires. Clean up of the spent chemicals is generally required, which adds to the expense involved in their use. The circumstances in which chemical extinguishing agents may be used are also limited in certain respects. Some of the halogenated hydrocarbons, for example, are toxic and should not be used around personnel who are not equipped for protection against possible asphyxiation. Furthermore, inasmuch as the chemical agents function primarily by forming an inert layer over the burning material to prevent access of oxygen, rather than by cooling the burning material, there is a risk that extinguished, but smoldering fuel material will reignite if the chemical agent should, for any reason, become displaced, as for example, by a gust of wind. Thus, as a practical matter, the effectiveness of many chemical extinguishing agents is substantially reduced when used outdoors. Another notable limitation of certain of these products is their rather limited shelf life.

Accordingly, a need exists for a fire extinguishing method employing an agent having water's low cost and effectiveness, but which is without the above-noted disadvantages of water, and is also free of limitations inherent in the use of the alternative fire extinguishing agents heretofore available.

SUMMARY OF THE INVENTION

The present invention concerns a novel application of polymer products, referred to herein as polymer micro-bits, which are the subject of my U.S. Pat. Nos. 4,207,378 and 4,200,679.

Polymer micro-bits are derived from expanded, non-brittle, thermoplastic styrene-polymers; expanded, non-brittle, thermoplastic polyolefins; or flexible foamed polyurethanes, by disintegrating the starting polymer to eliminate substantially all closed cells therefrom. Disintegration of the polymer starting materials is carried out in the presence of water, without which deleterious heating and fusion of the non-brittle/flexible polymer starting materials would occur. It has now been discovered that as a result of undergoing disintegration in this manner, the micro-bits possess two significant characteristics which make them especially useful as a fire extinguishing agent.

First, the micro-bits are produced in a form in which they hold an amount of water many times their dry weight. For example, polystyrene micro-bits may be produced conveniently as an aqueous slurry whose water content is from about 50 to about 100 times the dry weight of the micro-bits. The shredding and tearing action of the comminutor gives rise to substantial folding and wrinkling of the micro-bits, which is believed to contribute significantly to their water holding capacity due to surface tension.

Second, the resultant aqueous slurry of polymer micro-bits is readily flowable, which enables dispensing by conventional fire fighting equipment, and yet the consistency is such that the micro-bits adhere or stick to a burning surface, whether horizonal or vertical, at the point of application so that the full cooling effect of the water content of the micro-bits is utilized. As a consequence of the adhering or sticking characteristic of the micro-bits, the smothering effect of steam generated from the water associated with the micro-bits is greater than that produced by an equivalent amount of water.

The composition of polymer micro-bits and water, as discharged from the comminutor, may be used immediately or it may be stored for later use. In general, the composition may be stored indefinitely with no adverse effect.

The composition is effective both in fighting wood and paper fires and chemical fires and may be applied as a fine spray or high velocity stream using state-of-the-art fire extinguishing equipment. For example, a hand portable, stored pressure, liquid dispensing fire extinguisher may be used for fighting relatively small fires. Alternately, the composition may be dispensed from a large capacity water supply tank, such as those normally found on fire trucks, for fighting larger fires.

The polymer micro-bits are non-toxic and may be used indoors, as well as outdoors. The spent micro-bits can be easily swept up, or incorporated into soil to improve its aeration.

Accordingly, an object of the present invention is to provide a fire extinguishing method employing an inexpensive agent which cools burning material in an efficient and effective manner, and minimizes the risk that smoldering, extinguished fuel material will reignite.

It is another object of the present invention to provide a fire extinguishing method employing a chemcial agent which adheres to a burning surface at the point of application and is not easily displaced.

It is also an object of the present invention to provide a fire extinguishing method employing an aqueous cooling agent which is useful in fighting Class A and Class B fires.

It is still another object of this invention to provide a fire extinguishing method employing an aqueous cooling agent which minimizes property damage and involves little clean-up effort.

It is another object of this invention to provide a fire extinguishing method employing an agent which prevents access of oxygen to the burning material.

It is a further object of this invention to provide a fire extinguishing method employing a chemical agent which is non-toxic.

It is also an object of the present invention to provide a fire extinguishing method employing a chemical agent having an exceptionally long shelf life.

Other objects and advantages will be apparent from the following detailed description of the invention.

DETAILED DESCRIPTION OF THE INVENTION

In accordance with the present invention Class A and Class B fires are extinguished by applying to the burning material a composition consisting essentially of polymer micro-bits and water.

The micro-bits used in the practice of this invention are produced from any expanded, thermoplastic styrene-polymer or lower polyolefin, or polyolefin composition, all of which are non-brittle in expanded form, or from a flexible foamed polyurethane.

Micro-bits of an expanded, thermoplastic styrene-polymer or lower polyolefin are more fully described, along with their process of preparation, in my U.S. Pat. No. 4,207,378, issued Apr. 29, 1980, the entire disclosure of which is incorporated in the present application by reference, as if actually recited herein in full. The expression "styrene-polymer" includes not only polystyrene itself, but also thermoplastic polymers of any polymerizable substituted styrenes, as well as co-polymers of styrene with one or more other compatible monomers, representative examples of which are set forth in the aforesaid U.S. Pat. No. 4,207,378. The lower polyolefin micro-bits may be formed from any ethylenically unsaturated hydrocarbon monomer having from 2 to 6 carbon atoms. The styrene-polymer and polyolefin micro-bits may be broadly described as being (a) from about 40 to about 325 microns long and from abut 20 to about 325 microns wide, (b) substantially free of intact cells of the expanded polymer starting material from which they are produced, (c) substantially non-uniform in outline, and (d) having a density about 85 percent or more of the density of the specific unexpanded polymer from which the aforesaid expanded polymers are produced.

The non-brittle styrene-polymers and polyolefins used as starting materials in the practice of the present invention are relatively flexible and, in general, have a density of 5 pounds/cubic foot or less. Styrene-polymers having a density from 1 to 2 pounds/cubic foot are especially suitable for the production of micro-bits.

Polyurethane micro-bits are produced from flexible polyurethane foams, the preparation and properties of which are described, for example, in the "Handbook of Foamed Plastics", Bender, Rene J., Section X, pp. 173–236, Lake Publishing Corporation, Libertyville, Ill., U.S.A. (1955); "Polyurethanes: Chemistry and Technology", Saunders & Frisch, Chapter VII, Part II, Interscience Publishers, New York, N.Y., U.S.A. (1964); and "The Development and Use of Polyurethane Foams", Doyle, E. N., pp. 233–256, McGraw-Hill Book Company, New York, N.Y., U.S.A. (1971).

The preparation of polyurethane micro-bits is fully described in my U.S. Pat. No. 4,200,679, the entire disclosure of which is incorporated in the present application by reference as if actually recited herein in full. The individual micro-bits may be generally described as tripodal particles with generally uneven length legs and no uniformity in outline, the particles being broken and consisting of inter-connected strand portions from boundaries of adjacent cells of the flexible foamed polyurethane. The strand portions are substantially free of intact cell windows and have hook-like projections showing indentations and flutes. The uneven leg lengths and hook-like projections result from the destruction of the cell windows of the flexible polyurethane foam from which the micro-bits are produced.

The expression "flexible polyurethane foam" is used herein in its art-recognized sense to signify a polyurethane foam derived from relatively low functionality components, such as polyether diols and toluene diisocyanate, and having controlled, mild cross-links which account for the flexibility and elasticity of the polymer. The density of the flexible polyurethane foams used to provided foamed polyurethane micro-bits generally should be no greater than 6.0 pounds/cubic foot, preferably ranging from about 1.0 to 3.0 pounds/cubic foot. Such foams generally show excellent recovery after 75% deflection with approximately less than 1% loss in height (as determined by American Society of Testing Materials D-1564-64T). Flexible polyurethane foam is readily available in the form of continuous foamed blocks which may conveniently be shredded into small discrete pieces.

The preferred polymer micro-bits for use in practicing this invention are those derived from polystyrene, because of their exceptionally high water-holding capacity. The expanded polymer starting material may be in any discrete free flowing form, such as pellets, crystals, cubes, beads, or coarsely ground waste or scrap polymer, having dimensions on the order of $\frac{1}{8}$ inch in thickness, $\frac{1}{4}$ inch in width and $\frac{3}{8}$ inch in length. The polymer is fed together with water into the confined comminuting chamber of a comminuting apparatus, such as the model DAS06 Fitz-Mill® (available from the Fitzpatrick Co. of Elmhurst, Ill.; see their Bulletin No. 152) equipped with model DS-225 broached, fixed comminuting elements, which are rotated at from about 4700 to about 8000 revolutions per minute and repeatedly impact on the feed polymer causing the discrete polymer pieces to follow a circular path in the chamber. The comminuting elements or blades drive the polymer feed against the edges of orifices arranged in screening array on the wall of the comminuting chamber, which are spaced only slightly apart from the ends of the comminuting elements. The action of the comminuting elements on the polymer feed in the comminuting chamber causes tearing, ripping and shearing of the discrete polymer pieces, converting them into micro-bits.

The amount of water charged into the comminuting chamber should be so proportioned to the polymer feed as to prevent the contents of the comminuting zone from reaching a temperature that would adversely affect the integrity of the polymer feed or the desired micro-bits. Moreover, the water should be sufficient to facilitate discharge of the polymer micro-bits through the openings of the screen forming the bottom of the comminuting chamber. In practice it has been found that the use of water in an amount from 50 to 100 times the weight of the polystyrene feed produces satisfactory results.

By following the procedure outlined above, an aqueous slurry of polystyrene micro-bits having a solids content from about 1% to about 2% by weight is produced at a rate of about 425 liters per hour.

Polyolefin and polyurethane micro-bits are prepared in a manner similar to that described above for polystyrene micro-bits.

Before the aqueous slurry of micro-bits is used in fire fighting it should preferably be diluted to a solids content of 1% by weight, or less, in order to minimize the chance of clogging the nozzle or hose of the fire extinguishing apparatus used to dispense it.

The fire extinguishing method of the present invention will be further understood by reference to the following examples describing the use of a composition of polystyrene micro-bits and water, as the fire extinguishing agent.

EXAMPLE I

Approximately 1200 grams of polystyrene micro-bits prepared in accordance with the procedure in Example 1 of my U.S. Pat. No. 4,207,378, and having a solids content of about 8% by weight was slurried in about 15 gallons of water in a 20 gallon container, with rapid agitation by a mechanical agitator. The slurry was transferred to a 500 gallon capacity water tank on a working fire truck and the tank was filled with water from a fire hydrant. The dilute slurry was maintained in suspension by pumping it out of and back into the tank via a by-pass line in the truck's pumping system.

Twenty-five gallons of used machine oil were poured into on half of a 275 gallon drum, and sufficient water was added to bring the oil level up to about an inch from the top. Approximately two gallons of gasoline were poured onto the oil layer with stirring to distribute the gasoline throughout the oil. The oil-gasoline mixture was then ignited and as the entire surface of the flammable liquid caught fire, a dense black smoke rose from the drum. After a short time the heat of the fire could be felt at a distance of twenty feet away.

A fine spray of the aqueous polystyrene micro-bits slurry from the tank was directed onto the burning liquid from a distance of about thirty feet using a one and a half inch diameter fire hose equipped with a standard Navy fire nozzle. The flames were completely extinguished in about thirty seconds using about twenty to twenty-five gallons of the slurry. The oil felt cool to the touch within a minute after extinguishment. Efforts to reignite the fire by touching a burning piece of paper to the oil layer were unsuccessful. This test was repeated with substantially the same results.

EXAMPLE II

A gallon of polystyrene micro-bits prepared in accordance with Example 1 of the aforesaid U.S. Pat. No. 4,207,378, and having a solids content of about 2% by weight was combined with one and a half gallons of water to form a slurry, which was charged into a two-and-a-half gallon, portable, water fire extinguisher, pressurized by compressed air.

Several wooden boards four feet by eight inches by one half inch nailed side-by-side in a vertical arrangement were set on fire. After the wood was completely aflame, the aqueous slurry of polystyrene micro-bits was sprayed onto it from the extinguisher and the fire was extinguished in less than five seconds. It was noted that the micro-bits adhered to the vertical surfaces to which they were applied.

The fire extinguishing composition used in the present invention may include various additives such as corrosion inhibitors, flow conditioners or coloring agents. If desired the composition may also contain a fire retardant which interferes with the combustion reaction. Such additives may be easily incorporated into the the composition either in the form of liquids or very finely divided solids. Solid additives are readily retained by the micro-bits due to their exceptional fine particle-holding capacity.

The optimum solids content of the fire extinguishing composition of the present invention will vary depending on the specific type of polymer micro-bits selected. In the case of polystyrene, for example, the preferred solids content of the composition is from 0.01% to 0.5%. At a solids content much above 0.5%, there is a tendency for the slurry to clog the dispensing apparatus, whereas below 0.01% the amount of micro-bits is too low to achieve the advantages of this invention. It is preferable to operate at the upper end of the solids content range since the higher the concentration of micro-bits, the faster the fire will be extinguished. However, the solids content should not be so high as to interfere with the proper functioning of the dispensing apparatus.

When the fire extinguishing composition is dispensed from a tank having a capacity of 5 gallons or more, it is recommended that agitation be provided to maintain the micro-bits in suspension. Techniques for accomplishing this are well known to those skilled in the art.

From the foregoing disclosure it will be appreciated that the method of the present invention enhances the capabilities of water as a fire extinguishing agent against Class A fires, and broadens its range of application to include Class B fires. This invention provides an effective and relatively inexpensive fire extinguishing method which may be used advantageously by municipal, industrial, airport and military fire departments.

While the invention has been described in terms of a preferred embodiment, many other useful embodiments will be apparent to those skilled in the art. Accordingly, the invention is not limited to the particular embodiments described, but is subject to variation and modification without departing from the spirit and scope of the invention, as defined in the appended claims.

What is claimed is:

1. A fire extinguishing method for Class A and Class B fires comprising applying to the burning material a composition consisting essentially of polymer micro-bits and water, said micro-bits being produced by disintegrating a polymer selected from the group of an expanded, non-brittle, thermoplastic styrene-polymer; an expanded, non-brittle, thermoplastic polyolefin, which is the polymer of an ethylenically unsaturated hydrocarbon having from 2 to 6 carbon atoms; or a flexible foamed polyurethane, to eliminate substantially all closed cells from said polymer.

2. The method according to claim 1 wherein the polymer micro-bits are polystyrene.

3. The method according to claim 1 wherein said composition is an aqueous slurry of polystyrene micro-bits having a solids content of 1% by weight, or less.

4. The method according to claim 3 wherein said slurry has a solids content of 0.01 to 0.5% by weight.

* * * * *